US006354255B1

(12) United States Patent
Methley et al.

(10) Patent No.: US 6,354,255 B1
(45) Date of Patent: Mar. 12, 2002

(54) VALVE ACTUATING MECHANISM

(75) Inventors: Ian Methley, Witney; Timothy Mark Lancefield, Bicester, both of (GB)

(73) Assignee: Mechadyne PLC, Oxfordshire (GB)

( * ) Notice: Subject to any disclaimer, the term of this patent is extended or adjusted under 35 U.S.C. 154(b) by 0 days.

(21) Appl. No.: 09/724,687

(22) Filed: Nov. 28, 2000

(30) Foreign Application Priority Data

Dec. 9, 1999 (GB) ..... 9929016

(51) Int. Cl.[7] ..... F01L 13/00

(52) U.S. Cl. ..... 123/90.16; 123/90.17; 123/90.6

(58) Field of Search ..... 123/90.15, 90.16, 123/90.17, 90.31, 90.39, 90.48, 90.6; 74/568 R

(56) References Cited

U.S. PATENT DOCUMENTS 4,397,270 A * 8/1983 Aoyama ..... 123/90.16
4,572,118 A * 2/1986 Baguena ..... 123/90.16
5,111,781 A * 5/1992 Kaku et al. ..... 123/90.16
5,189,998 A * 3/1993 Hara ..... 123/90.16
5,899,180 A * 5/1999 Fischer ..... 123/90.16
5,937,809 A * 8/1999 Pierik et al. ..... 123/90.16
5,996,540 A * 12/1999 Hara ..... 123/90.16
6,019,076 A * 2/2000 Pierik et al. ..... 123/90.16
6,041,746 A * 3/2000 Takemura et al. ..... 123/90.16

* cited by examiner

*Primary Examiner*—Weilun Lo
(74) *Attorney, Agent, or Firm*—Smith-Hill and Bedell

(57) ABSTRACT

A valve actuating mechanism is disclosed which comprises a valve (12), a camshaft having a cam (22) of fixed profile associated with the valve (12), a valve lifting rocking cam (24) pivotable about a fixed axis and having a contoured surface that acts to open and close the valve (12) as the rocking cam (24) pivots about said fixed axis, and a cam following rocker (26) comprising a cam follower (46) in contact with the fixed profile cam (22) on the camshaft and coupled to the rocking cam (24) in order to cause the rocking cam (24) to pivot about the fixed pivot axis with rotation of the camshaft. The rocker (26) is pivotable about a second axis that is movable relative to the fixed pivot axis of the rocking cam (24) in such a manner as to allow the valve lift, phase and duration of the valve event to be varied in dependence upon the position of the pivot axis of the rocker (26). In accordance with the invention, the rocking cam (24) and rocker (26) are pivotable about a cranked shaft that is rotatable about the same axis as the rocking cam (24), the rocker (26) being mounted on an offset crank of the cranked shaft.

5 Claims, 7 Drawing Sheets

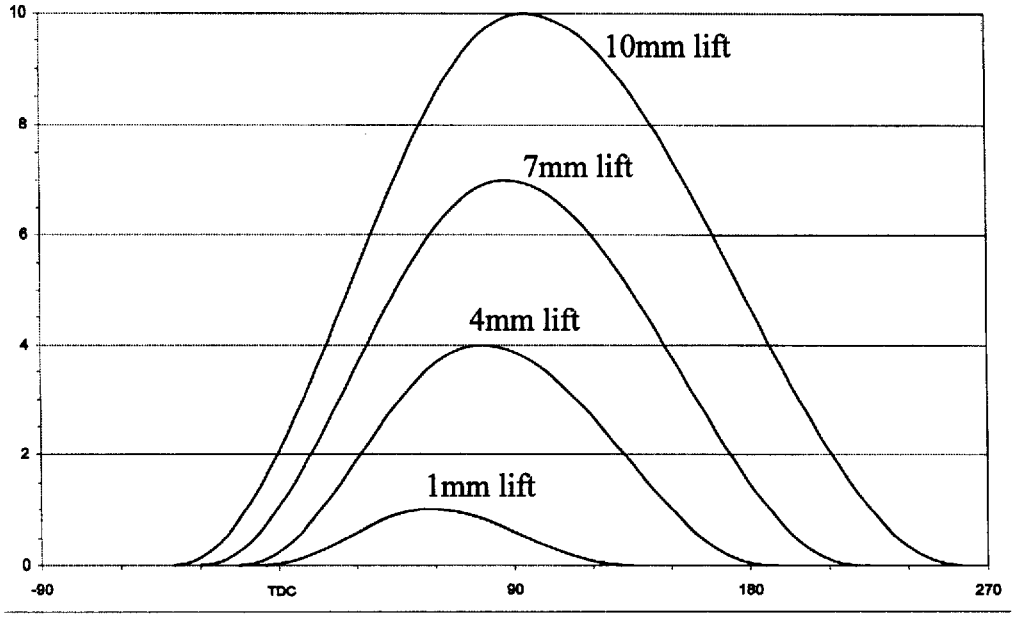
Fig. 9
Fig. 10
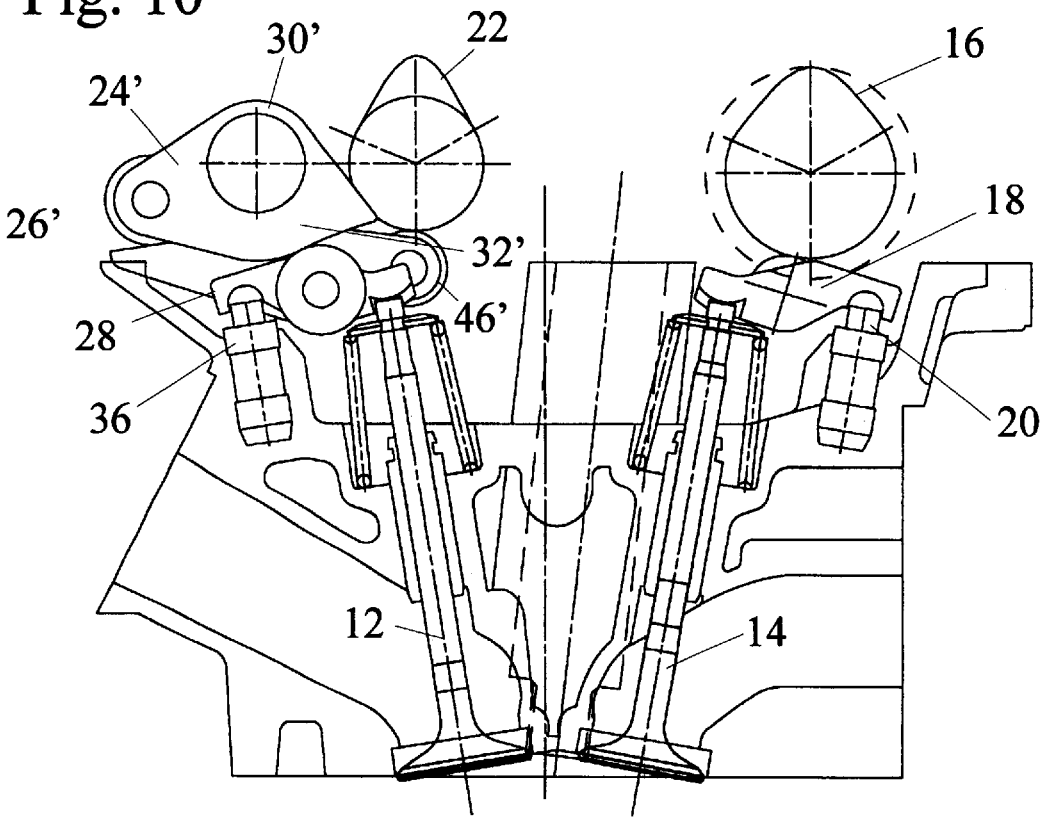

VALVE ACTUATING MECHANISM

FIELD OF THE INVENTION

The present invention relates to a valve actuating mechanism.

BACKGROUND OF THE INVENTION

It has been proposed in the prior art to interpose a lever between a fixed profile cam on a camshaft and a valve operated by the cam. By moving the pivot axis of the lever, it is possible to modify the valve lift.

OBJECT OF THE INVENTION

The invention seeks to provide an improvement of such a valve actuating mechanism that permits not only the valve lift to be varied but also the event duration and phase while still using a camshaft having fixed profile cams.

SUMMARY OF THE INVENTION

According to the present invention, there is provided a valve actuating mechanism comprising a valve, a camshaft having a cam of fixed profile associated with the valve, a valve lifting rocking cam pivotable about a fixed axis and having a contoured surface that acts to open and close the valve as the rocking cam pivots about said fixed axis, and a cam following rocker comprising a cam follower in contact with the fixed profile cam on the camshaft and coupled to the rocking cam in order to cause the rocking cam to pivot about the fixed pivot axis with rotation of the camshaft, the rocker being pivotable about a second axis that is movable relative to the fixed pivot axis of the rocking cam in such a manner as to allow the valve lift, phase and duration of the valve event to be varied in dependence upon the position of the pivot axis of the rocker, characterised in that the rocking cam and rocker are pivotable about a cranked shaft that is rotatable about the same axis as the rocking cam, the rocker being mounted on an offset crank of the cranked shaft.

BRIEF DESCRIPTION OF THE DRAWINGS

The invention will now be described further, by way of example, with reference to the accompanying drawings, in which:

FIG. 9 is a plot of valve lift versus crankshaft angle, showing the manner in which the position of the rocker affects the phase, duration and maximum lift of the inlet valve, FIG. 10 is a view similar to that of FIG. 1, showing an alternative embodiment of the invention.

DETAILED DESCRIPTION OF THE PREFERRED EMBODIMENT

Figure 1:
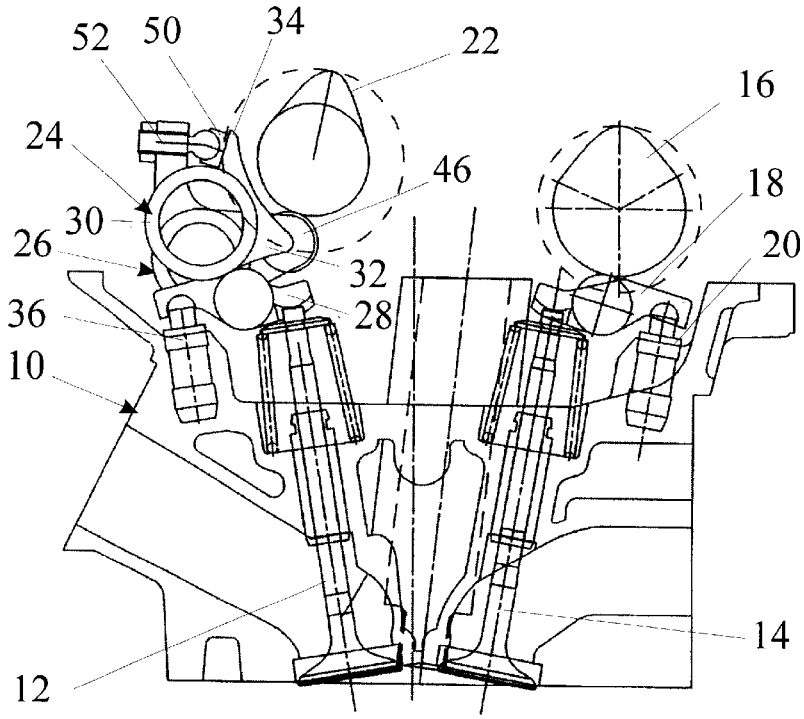
FIG. 1 is a schematic representation of an engine cylinder head having an intake valve fitted with a valve actuating mechanism of the invention, the view being a section through the valve lifting rocking cam showing the cam following rocker positioned to allow maximum valve lift but with its cam follower on the base circle of the cam.
Figure 2:
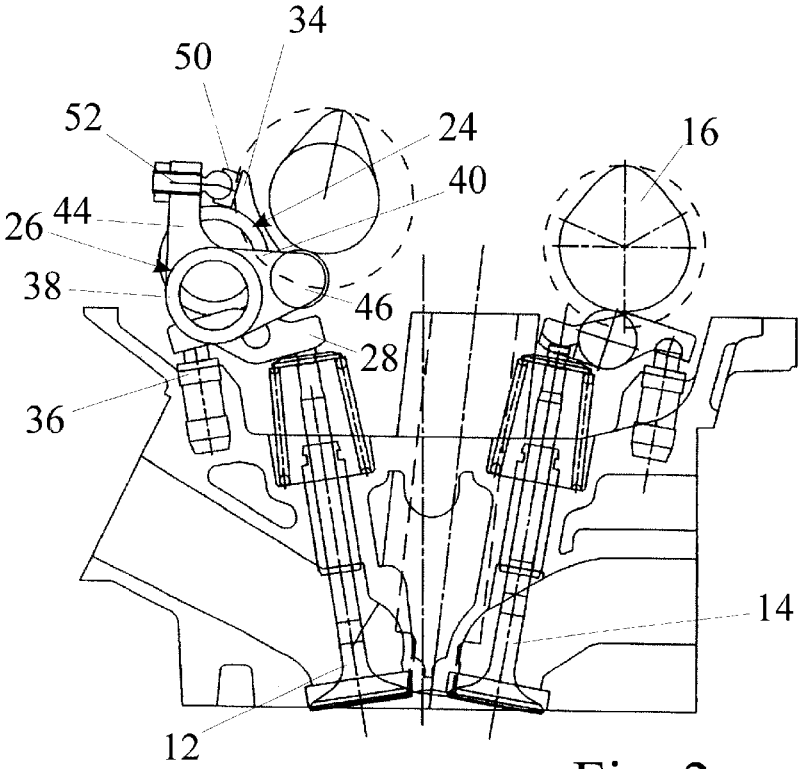
FIG. 2 is a section through the rocker of the mechanism of FIG. 1 with the rocker and the rocking cam in the same position as shown in FIG. 1.

FIG. 1 to 8 all relate to a first embodiment of the invention and show an engine cylinder head 10 having an intake valve 12 and an exhaust valve 14. The exhaust valve 14 is operated in a conventional manner by a cam 16 that acts on the exhaust valve 14 by way of a cam follower rocker 18. The cam follower rocker 18 is pivoted at one end on a post 20 that is adjustable in order to set the valve clearance and preferably includes a hydraulic lash adjuster. At its other end, the cam follower rocker 18 is in contact with the stem of the valve 14 and at its centre there is rotatably mounted a roller in contact with the cam 16.

The intake valve 12, on the other hand, is operated by an actuating mechanism of the invention. The actuating mechanism comprises a cam lobe 22 fixed on a separate camshaft that acts indirectly on the end of the stem of the intake valve 12.

The stem of the valve 12 is acted upon by a conventional follower rocker 28 that is actuated by a rocking cam 24 which pivots around a fixed axis. In particular, the rocking cam 24 comprises a ring 30 that engages a support shaft 25, a contoured lobe 32, projecting to the right (as viewed) from the ring 30 and a radial abutment 34. The contoured lower surface of the lobe 32 (as viewed) acts n the cam follower rocker 28 that is generally similar to the cam follower rocker 18, being pivoted at one end on a post 36 that incorporates a hydraulic lash adjuster and being in contact with the stem of the valve 12 at its other end. Because of the contoured lobe 32 on the rocking cam 24, when it rotates clockwise, as viewed, it depresses the cam follower rocker 28 which in turn opens the valve 12. For this reason, the rocking cam 24 is also termed the valve lifting rocking cam. In place of a cam follower rocker 28, it would alternatively be possible to use a conventional bucker tappet.

The valve lifting rocking cam 24 does not directly follow the cam 12 but instead is coupled to a rocker 26 that carries a cam follower 46. The cam following rocker 26 is best shown in the sections of the even numbered drawings. In particular, the rocker 26 is a bell crank lever having two limbs 40 and 44 projecting approximately at right angles to one another from a ring 38 that rotates about a support bearing that is movable in relation to the fixed support shaft of the rocking cam 24.

The first limb 40 of the rocker 26 carries the roller 46 that follows the surface of the cam lobe 22. The other limb 44 carries a shoe 50 on the part spherical end of an adjustable post 52. The shoe 50 lies in the same plane as the rocking cam 24 and remains in contact at all times with the radial abutment 34 of the rocking cam 24.

Figure 1A:
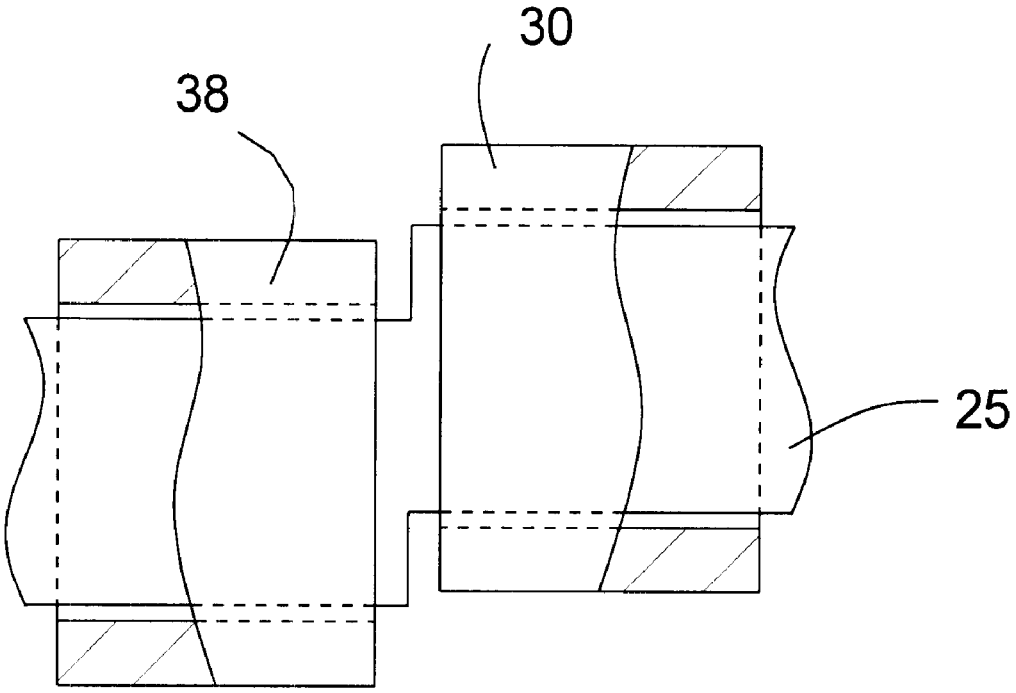
FIG. 1A is an enlarged partial view of the valve mechanism shown in FIG. 1, seen from the left of FIG. 1.
Figure 3:
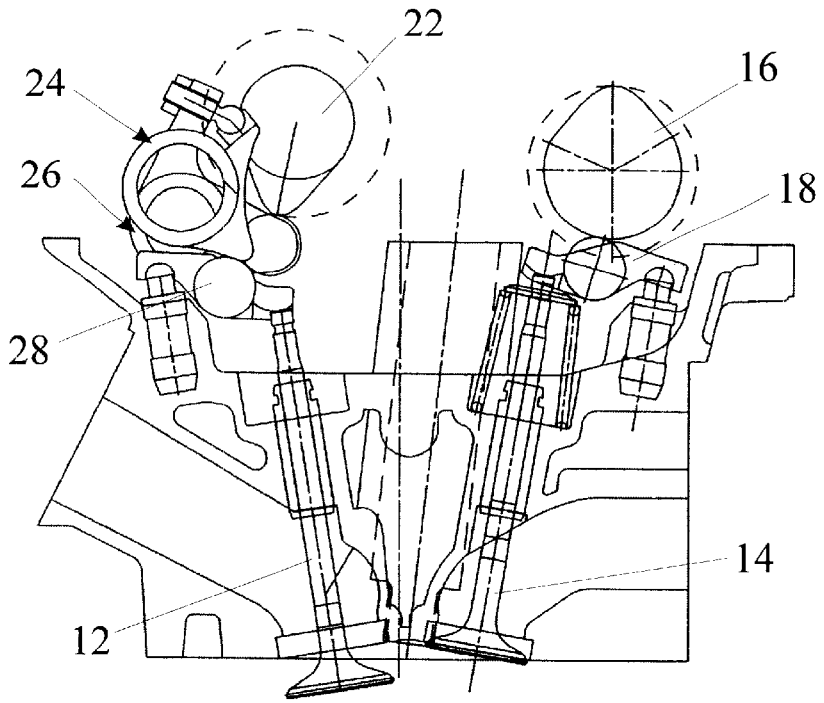
FIG. 3 is a section similar to that of FIG. 1 showing the cam follower rocker positioned to allow maximum valve lift and with its cam follower at full lift on the lobe of the cam.
Figure 4:
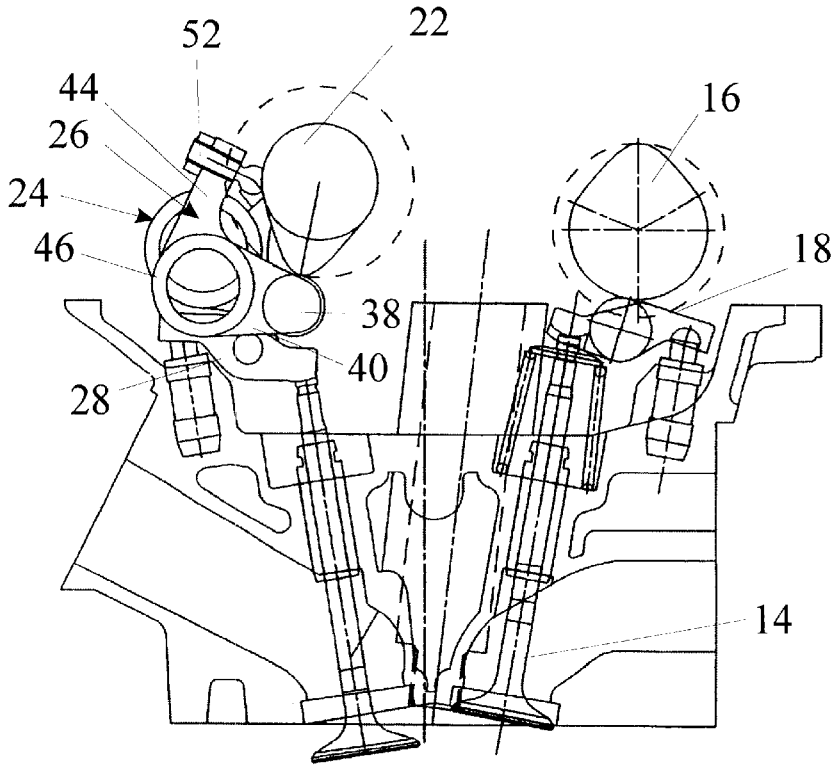
FIG. 4 is a section similar to that of FIG. 2 with the rocker and the rocking cam in the same position as shown in FIG. 3.
Figure 5:
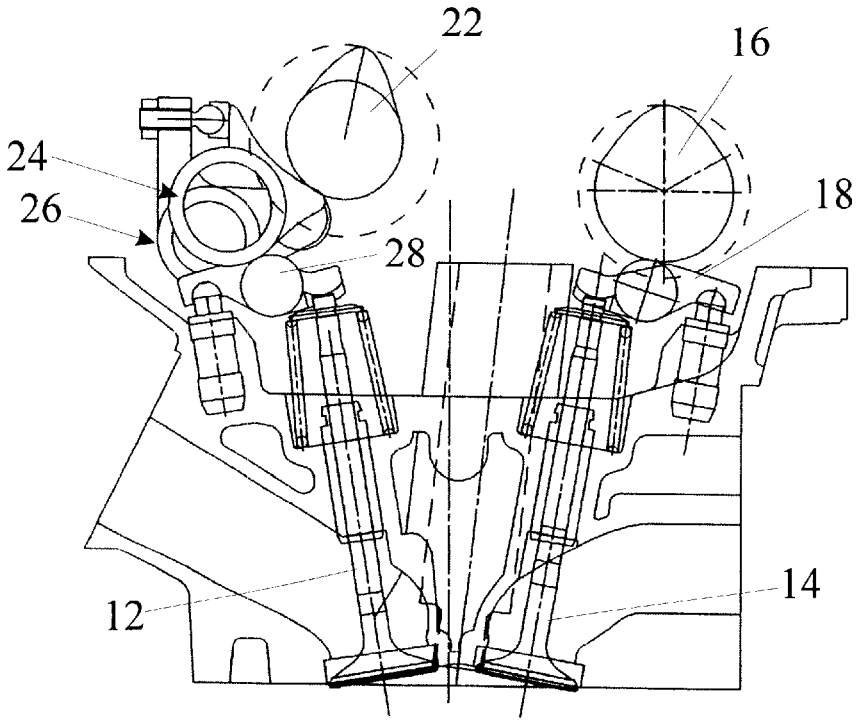
FIG. 5 is a section similar to that of FIG. 1 showing the cam follower rocker in its position for reduced valve lift but with its cam follower on the base circle of the cam.
Figure 6:
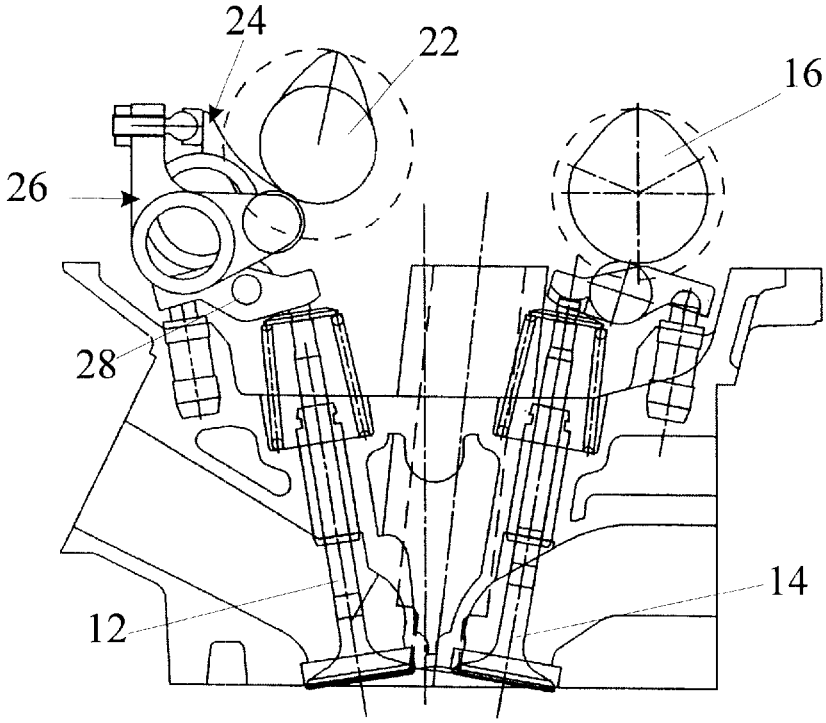
FIG. 6 is a section similar to that of FIG. 2 with the rocker and the rocking cam in the same position as shown in FIG. 5.

In multi-cylinder engine, there will be several rocking cams 24 and rockers 26 and these can be mounted on a shaft 25 (FIG. 1A), similar to an engine crankshaft, having fixed bearings on which are mounted the rocking cams and cranks on which are mounted the rockers. In this way, rotation of the shaft 25 about the axis of the fixed bearings will result in the rockers 26 only moving between the positions shown in the different figures of the drawings.

By comparing the different figures, it will be appreciated that the position of the cam follower rocker 28 relative to the contoured surface 32 of the rocking cam when the roller 46 of the rocker is resting on the base circle of the cam is varied when the position of the pivot axis of the rocker 26 is moved.

In the FIGS. 1 to 4, which correspond to maximum valve lift, the cam follower rocker 28 sits at the very edge of the base circle of the lobe 32 and the valve 12 commences to open immediately the cam follower roller 46 of the rocker 26 comes in contact with the cam lobe 22. This is because the cam lobe 22 causes the rocker 26 to rotate clockwise as viewed, and this rotation is transmitted to the rocking cam 24 on account of the contact between the shoe 50 on the rocker 26 and the radial abutment 34 on the rocking cam 24.

If the pivot axis of the rocker 26 is moved to the position shown in FIGS. 5 to 8, the cam follower rocker 28 sits on the base circle of the rocking cam at some distance from the lobe 32 and the valve 12 does not commence to open immediately the cam follower roller 46 of the rocker 26 comes in contact with the cam lobe 22. Instead, the initial rotation of the rocker 26 under the action of the cam lobe 22, when conveyed to the rocking cam 24 through the shoe 50 and the radial abutment surface 34 will only move the cam follower rocker 28 along the base circle of the rocking cam 24. This movement will not be accompanied by any valve lift. Further rotation of the first and rockers 24 and 26 will cause the cam follower rocker 28 to be depressed by the lobe 32 of the contoured surface of the rocking cam but the maximum lift will be reduced.

Figure 7:
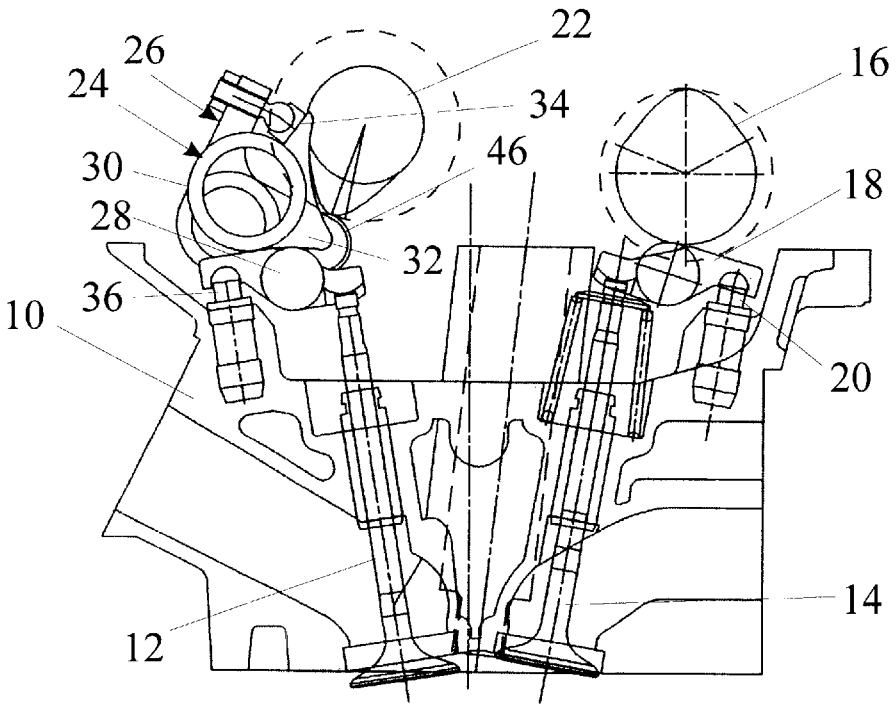
FIG. 7 is a section similar to that of FIG. 1 showing the cam follower rocker positioned to allow reduced valve lift and with its cam follower at full lift on the lobe of the cam.
Figure 8:
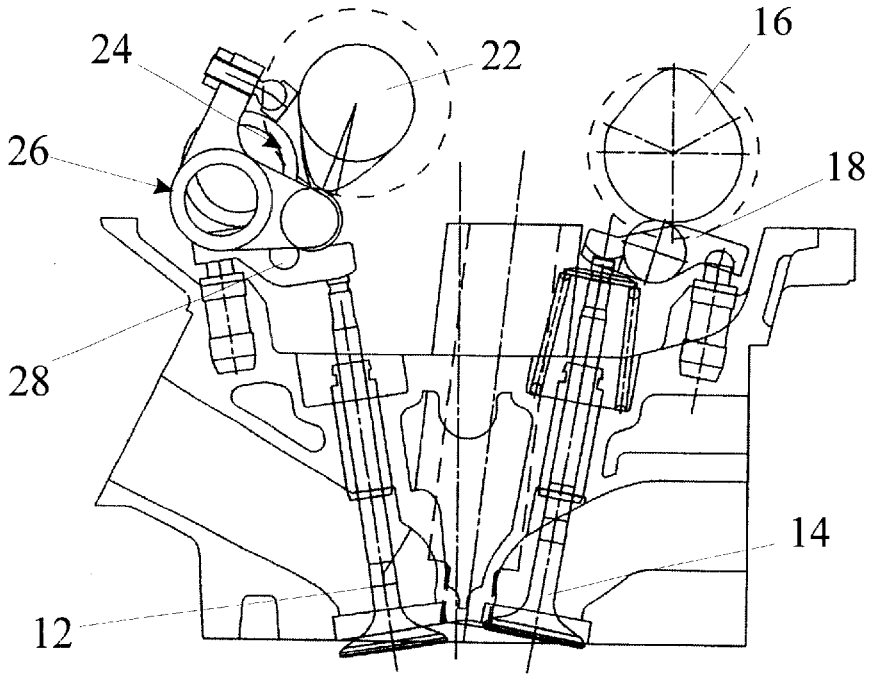
FIG. 8 is a section similar to that of FIG. 2 with the rocker and the rocking cam in the same position as shown in FIG. 7.

FIG. 9 shows that moving the position of the pivot axis of the rocker does not merely reduce the valve lift but also reduces the event duration and slightly affects the phase. The phase shift occurs because the centre of rotation of the rocker 26 moves in relation to the camshaft and, as a result, the roller 46 moves around the base circle of the cam. The two lines on the cam profile in FIGS. 7 and 8 show the extent of the phase shift. The phase shift that occurs is related to the lift and duration but if it is desired to vary the phase of the intake valves independently of the peak lift then this may be achieved by varying the phase of one or both of the cams 16, 22 by means of a suitable phase change mechanism, many examples of which are to be found in the prior art.

The shoe 50 and the radial abutment 34 are designed to maintain surface contact between the rocking cam 24 and the rocker 26 in all positions of the axis of the rocker 26. It will be appreciated that other forms of coupling may be employed, for example a pin projecting from one of these elements may engage in a slider slidably mounted on the other. As a further possibility a fixed abutment may be provided on the rocker and a slider or roller may be mounted on the rocking cam 24.

Figure 11:
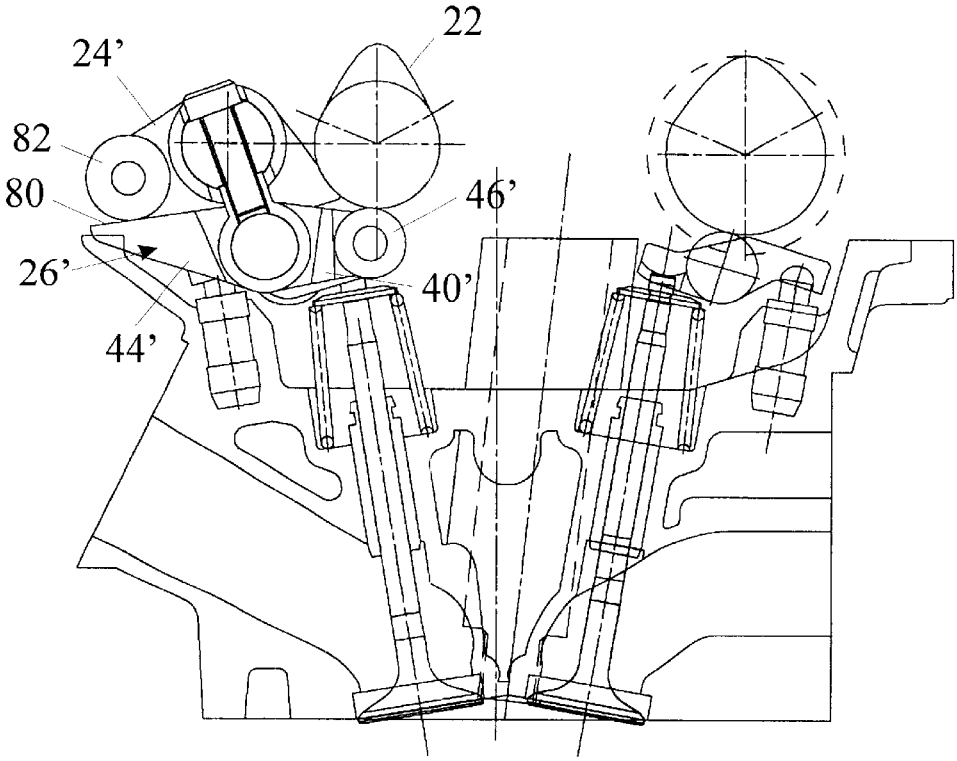
FIG. 11 is a view similar to that of FIG. 2 showing the alternative embodiment of FIG. 10.

A still further alternative is shown in FIGS. 10 and 11 in which the shoe 50 has been replaced by a roller 82 on the rocking cam that rolls along a radial abutment surface 80 on the cam follower rocker. The embodiment of FIGS. 10 and 11 is generally similar to the first described embodiment and to avoid repetition of the description identical components in the two embodiments have been allocated the same reference numerals whereas differently shaped elements serving the same function have had a prime added to the reference numeral. Instead of the rocker 26' being shaped as a bellcrank lever, its two arms 40' and 44' are in this case arranged in line with one another, and the arm 44' is formed with the abutment surface 80 on which rolls the roller 82 mounted on the valve lifting rocking cam 24'.

If it is additionally required to phase shift the entire valve event in relation to the phase of the engine crankshaft, it is possible to provide a variable phase drive coupling in the sprocket, cog or pulley driving the cam 22. Various variable phase drive couplings are known in the art, and suitable such coupling is shown in section in FIG. 12 of the drawings.

Figure 12:
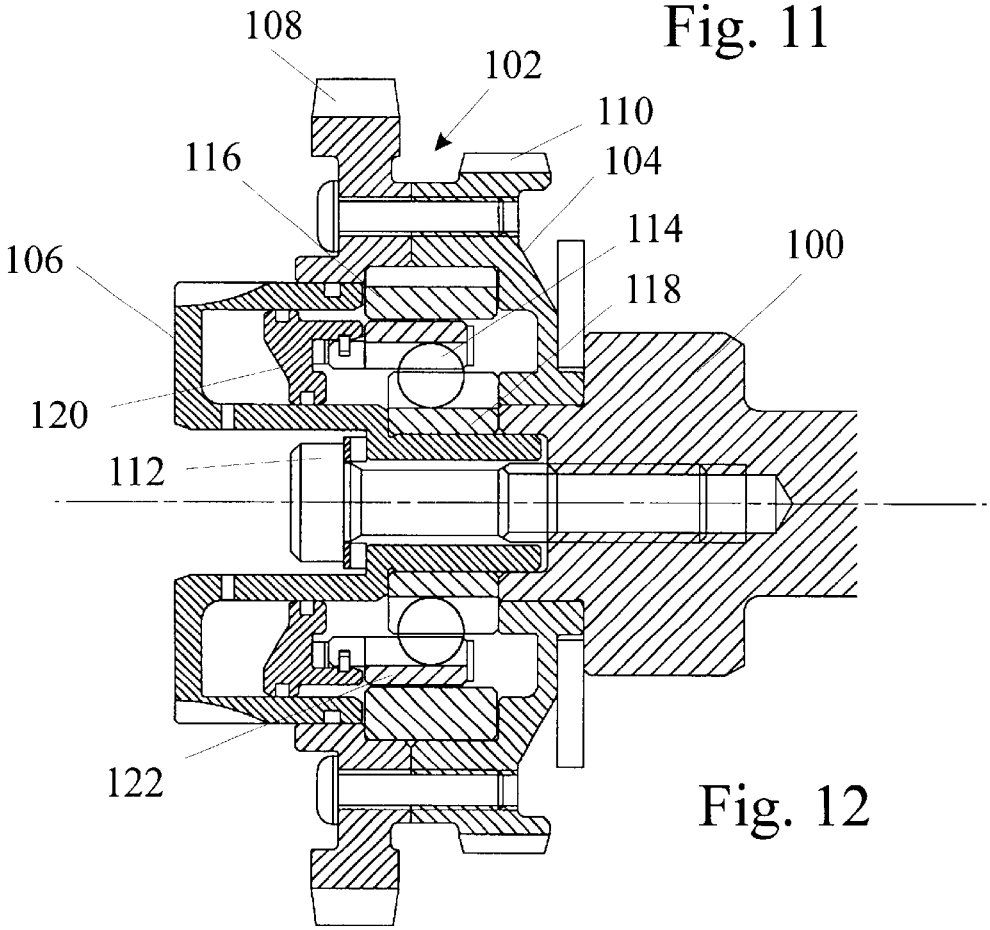
FIG. 12 is a section through a variable phase drive coupling incorporated into a drive sprocket and driving a camshaft.

In FIG. 12, a camshaft 100 is connected to a drive coupling 102 that comprises a drive member 104 and a driven member 106. The drive member 104 has sprocket teeth 108, 110 around which pass two chains, one driven by the crankshaft and the other can be used, for example, to drive a balancing shaft. The drive member 104 is mounted on a bearing so that it may rotate relative to the camshaft 100. The driven member, on the other hand, is connected to the camshaft 100 by a bolt 112. The drive and driven members are coupled for rotation with one another by means of two sets of rolling elements 114 (only one set being visible in the section plane of the drawing). The first set of rolling elements 114 engages in helical grooves on an inner race 116 and on the inner surface of an intermediate member 122, while the second set (not shown) engages is helical grooves on an outer race 118 and on the outer surface of the intermediate member 122, the helical grooves having a different pitch from one another.

The intermediate member 122 is connected to an annular piston 120 so that it may be moved axially relative to the races 116 and 118. Because of the different helical grooves on the races, such axial movement results in the driven member 106 being rotated relative to the drive member 104 so as to effect the required phase change.

The construction of the variable phase drive coupling is further described in WO99/06675 but it should be stressed that this coupling has been cited only by way of example and one may alternatively use other suitable variable phase couplings that are known in the prior art.

It will be appreciated that many modifications may be made, in particular to the geometry of various components of the valve actuating mechanism, without departing from the scope of the invention as set forth in the appended claims.

What is claimed is:

1. A valve actuating mechanism comprising a valve, a camshaft having a cam of fixed profile associated with the valve, a valve lifting rocking cam pivotable about a fixed axis and having a contoured surface that acts to open and close the valve as the rocking cam pivots about said fixed axis, and a cam following rocker comprising a cam follower in contact with the fixed profile cam on the camshaft and coupled to the rocking cam in order to cause the rocking cam to pivot about the fixed pivot axis with rotation of the camshaft, the rocker being pivotable about a second axis that is movable relative to the fixed pivot axis of the rocking cam in such a manner as to allow the valve lift, phase and duration of the valve event to be varied in dependence upon the position of the pivot axis of the rocker, wherein the rocking cam and rocker are pivotable about a cranked shaft that is rotatable about the same axis as the rocking cam, the rocker being mounted on an offset crank of the cranked shaft.

2. A valve actuating mechanism as in claim 1, wherein the rocking cam acts to open and close the valve by way of a cam follower engaging the contoured surface of the rocking cam.

3. A valve actuating mechanism as claimed in claim 1, further comprising a phase change mechanism connected to vary the phase of rotation of the camshaft.

4. A valve actuating mechanism as in claim 1, wherein the rocking cam and the rocker are coupled to one another by means of a shoe pivotably mounted on one of the rocking cam and the rocker and in contact with a radial abutment surface on the other.

5. A valve actuating mechanism as claimed in claim 1, wherein the rocking cam and the rocker are coupled to one another by means of a roller on the one that rolls on a surface of the other.

* * * * *